US007124523B2

(12) United States Patent
Asvadi et al.

(10) Patent No.: US 7,124,523 B2
(45) Date of Patent: Oct. 24, 2006

(54) COOL-ZONE IRON

(75) Inventors: Sima Asvadi, Eindhoven (NL); Eduard Josephus Hultermans, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 74 days.

(21) Appl. No.: 10/496,545

(22) PCT Filed: Nov. 25, 2002

(86) PCT No.: PCT/IB02/04799

§ 371 (c)(1),
(2), (4) Date: May 25, 2004

(87) PCT Pub. No.: WO03/046272

PCT Pub. Date: Jun. 5, 2003

(65) Prior Publication Data

US 2005/0005480 A1 Jan. 13, 2005

(30) Foreign Application Priority Data

Nov. 29, 2001 (EP) ..... 01204608

(51) Int. Cl.
*D06F 75/38* (2006.01)

(52) U.S. Cl. ..... 38/93

(58) Field of Classification Search ..... 38/74, 38/77.7, 80, 81, 89, 93, 95, 97; 219/245
See application file for complete search history.

(56) References Cited

U.S. PATENT DOCUMENTS 2,362,590 A * 11/1944 Smith ..... 38/75
2,552,988 A * 5/1951 Machanic ..... 38/79
2,629,949 A * 2/1953 Gerber et al. ..... 38/75
4,347,428 A * 8/1982 Conrad et al. ..... 219/251
5,333,401 A * 8/1994 Klein ..... 38/89

* cited by examiner

*Primary Examiner*—Ismael Izaguirre
(74) *Attorney, Agent, or Firm*—Adam L. Stroud

(57) ABSTRACT

An iron is provided having a housing, a soleplate which is to be moved in a displacement direction over a fabric during operation, and a heating element for heating the soleplate, the soleplate having a cooling element for setting at least a portion of the fabric during operation, which cooling element is provided, seen in the displacement direction, behind the heating element. After heating of the fibers in the fabric, the cooling element in the soleplate subsequently cools the fibers in the fabric which are under tensile and compression forces because the soleplate is still in contact with the fabric. This causes the fibers to become set quickly and effectively, which improves the result of the ironing.

12 Claims, 3 Drawing Sheets

COOL-ZONE IRON

Figure 1A:
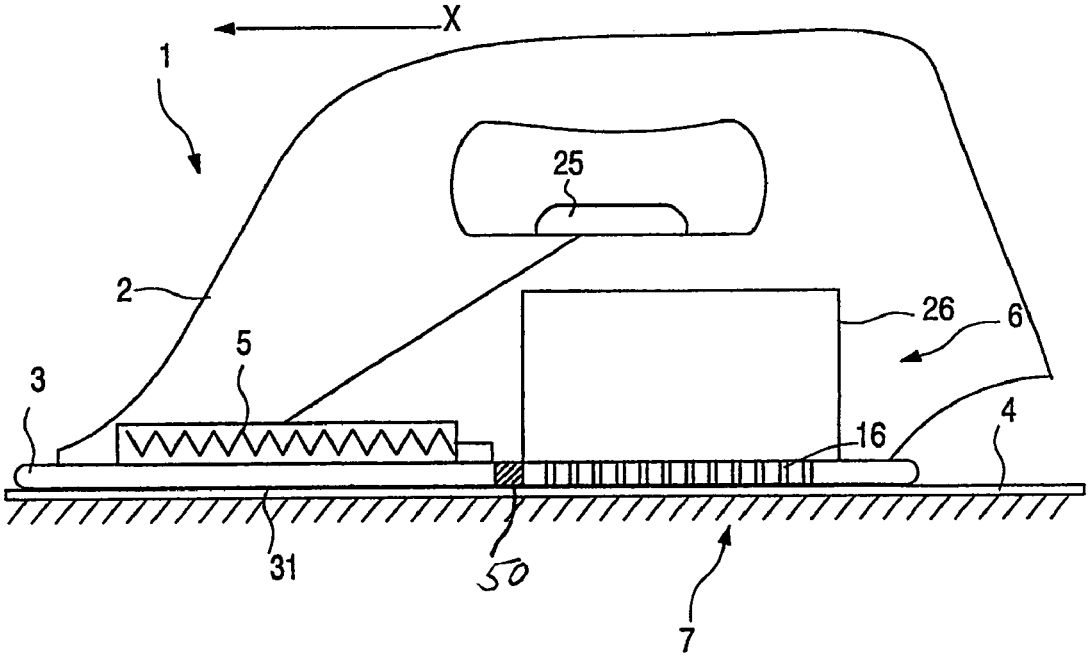

The invention relates to an iron comprising a housing, a soleplate which is to be moved in a displacement direction over a fabric during operation, and heating means for heating the soleplate.

An iron of the type defined in the opening paragraph is generally known. During operation the iron is moved over a fabric in a displacement direction, and the soleplate, heated by the heating means, heats the fibers in the fabric present below the soleplate. When the soleplate is lifted up from the fabric, the fabric is exposed to the ambient temperature and a slow cooling down of the fabric takes place. This cooling results in a setting of the fibers in the fabric, which causes the fabric to have fewer creases. With this known iron, the effects of the ironing on the fabric are satisfying in themselves, but attempts are always being made to achieve even better and longer-lasting results of the ironing on the fabric.

It is an object of the invention to provide an iron which offers an improved setting of the fabric and thus an improved ironing result.

To achieve this object, an iron according to the invention is characterized in that the soleplate comprises cooling means for setting at least a portion of the fabric during operation, which means are provided, seen in the displacement direction, behind a part of the soleplate which is heated by the heating means. It has been found that the setting of the fibers in the fabric is improved if the fabric is cooled down after heating while the soleplate is still in contact with the fabric. When the iron is moved over the fabric, the weight and movement of the iron cause tensile and compression forces in the fibers. The heating means in the soleplate furthermore heat a part of the soleplate, which heats the fibers in the fabric. This causes the fibers to stretch and become softer and movable. The cooling means comprised in the soleplate behind the heated part subsequently cool down the fibers in the fabric which are under tensile and compression forces because the soleplate is still in contact with the fabric. This causes the fibers to become set quickly and effectively, which improves the result of the ironing.

An embodiment of an iron according to the invention is characterized in that the cooling means are provided in at least a rear part of the soleplate, seen in the displacement direction. In this manner cooling down of the fabric takes place during operation at least at the end of one ironing stroke in the displacement direction over the fabric, which enhances the setting of the fibers in the fabric.

An embodiment of an iron according to the invention is characterized in that the cooling means comprise a plurality of air vents which are provided in the soleplate and are connected to a unit for generating an air flow through the air vents during operation. This relatively simple construction offers an effective cooling and thus setting of the fabric during operation.

An embodiment of an iron according to the invention is characterized in that the soleplate comprises at least a first zone which is heated by the heating means during operation, and the cooling means comprise at least a second zone which is cooled by a cooling device during operation. The cooling means comprise a specific part of the soleplate, which is cooled by a cooling device. In this manner the heating and the cooling are concentrated in specific areas of the soleplate, which may be arranged in a preferred manner during manufacture depending on, for example, the types of fabric to be ironed.

It is advantageous when a thermal insulation is provided between the first zone and the second zone.

An embodiment of an iron according to the invention is characterized in that the cooling means have a controllable cooling rate. Fabrics have various ironing temperatures, dependent on their characteristics. This brings with it that the heating of the soleplate should also vary in dependence on the type of fabric to be ironed. To optimally cool down various fabrics during ironing, the degree of cooling may be matched to the degree of heating the fabric is exposed to. A fabric that is heated with a relatively high heating temperature during ironing requires a higher cooling rate to cool down the fabric compared with a fabric that has a lower heating temperature. When the cooling rate of the cooling means is controllable, it can be adapted to the type of fabric that is to be ironed.

It is advantageous when the cooling device comprises at least one Peltier element. The Peltier element has cooling characteristics which are suitable for providing cooling in a soleplate of an iron, and can be easily integrated into an iron owing to its relatively small size. It furthermore provides a relatively easy control of its cooling rate.

An embodiment of an iron according to the invention is characterized in that the soleplate comprises a plurality of zones which are heated during operation and a plurality of zones which are cooled during operation. When various heating and cooling zones are provided on the soleplate, the fabric is repeatedly exposed to alternate heating and cooling actions during operation, which further enhances the setting and fixation of the fibers in the fabric.

A further embodiment of an iron according to the invention is characterized in that the cooling means comprise a water reservoir and a thermal connection between the water reservoir and the soleplate. During operation the soleplate is moved over the fabric which is first heated by the heating means. The heated fabric then comes into contact with the part of the soleplate which is connected to the water reservoir via a thermal connection. The heat of the fabric is then at least partly transferred via the thermal connection to the water reservoir, which causes the fabric to be cooled down to a lower temperature.

An embodiment of an iron according to the invention is characterized in that the thermal connection comprises an element made of a material with a comparatively high thermal conductivity, which element has one end which is in thermal contact with the water reservoir and another end which is in thermal contact with the soleplate. In this manner the element made of a material with a comparatively high thermal conductivity, is used as the medium via which the thermal contact between the soleplate and the water in the water reservoir takes place. Thus an efficient and cost-effective construction for the thermal connection is achieved.

An embodiment of an iron according to the invention is characterized in that the thermal connection comprises a channel which has one end which is in open communication with the water reservoir and another end which is in thermal contact with the soleplate. The water which is present in the water reservoir is also present in the channel. In this manner the water is used as the medium via which the thermal contact between the soleplate and the water in the water reservoir takes place. Thus another efficient and cost-effective construction for the thermal connection is achieved.

Figure 1B:
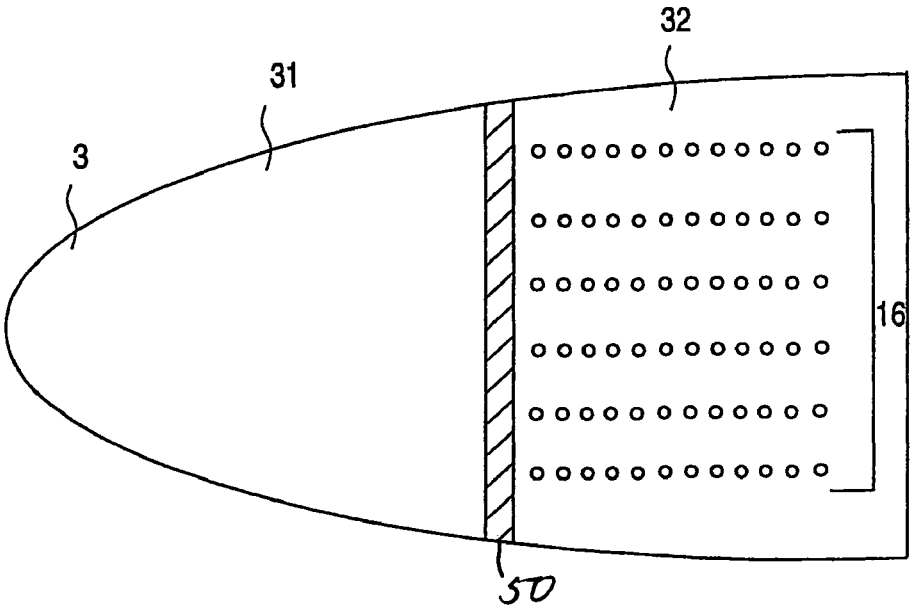
Figure 2:
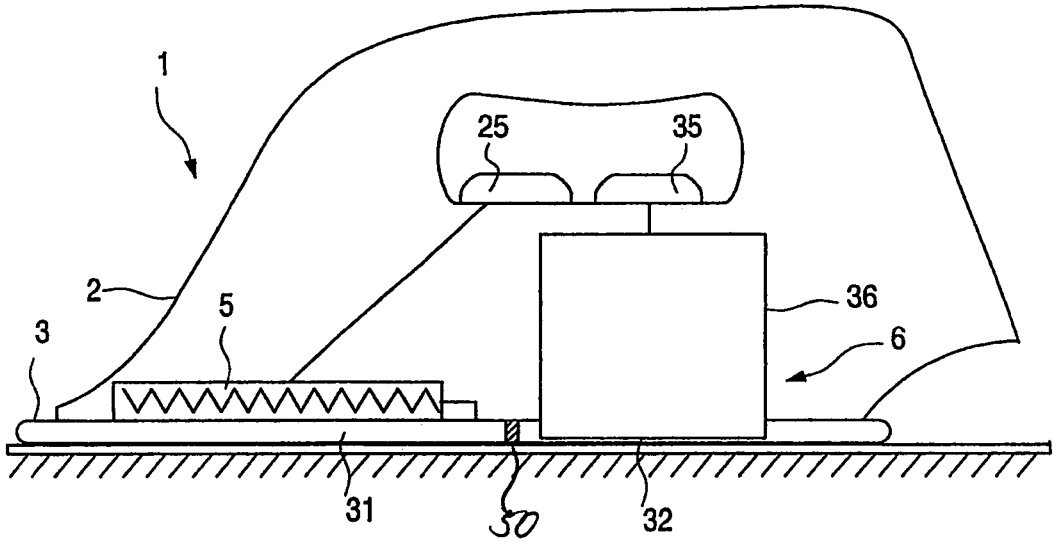
Figure 3:
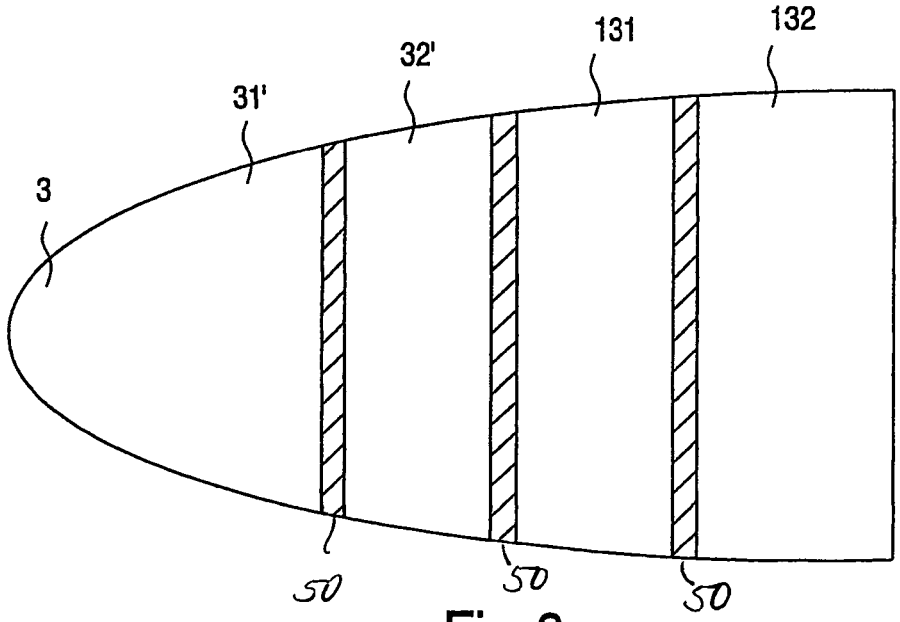
Figure 4A:
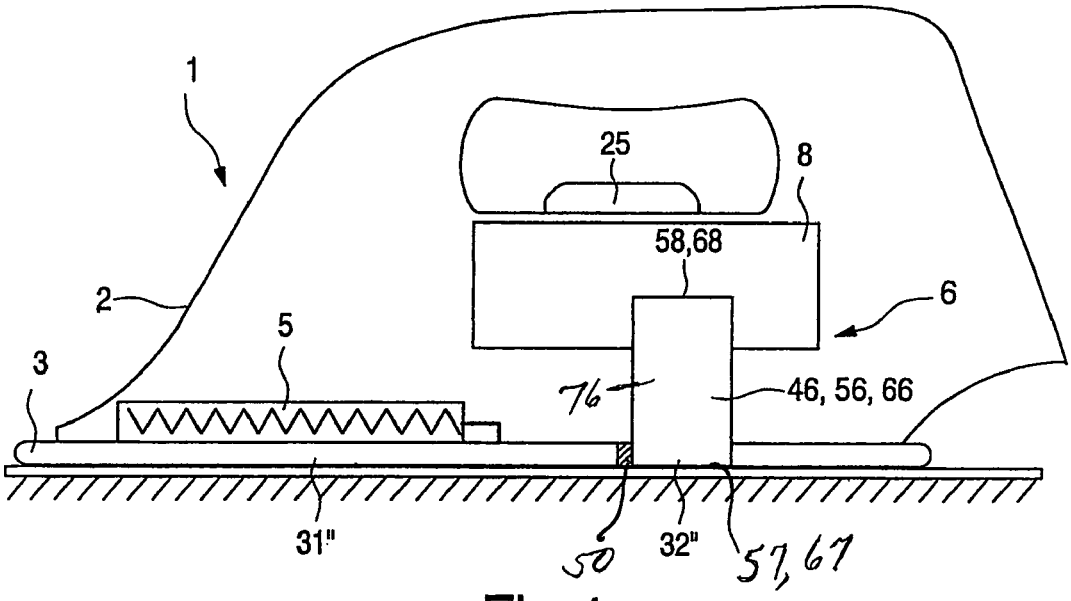
Figure 4B:
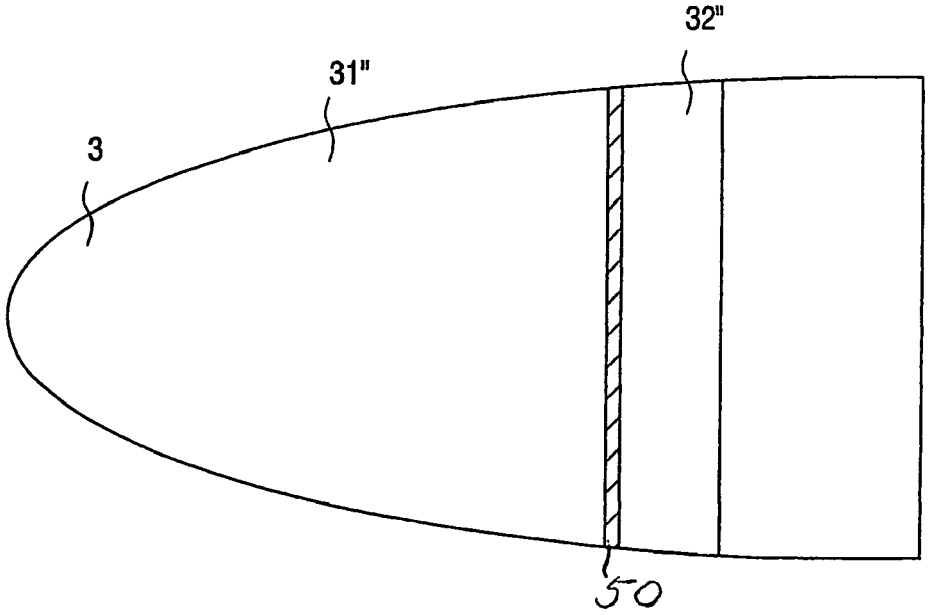

FIGS. 1*a* and 1*b* are diagrammatic views of a first embodiment of an iron according to the invention, FIG. 1*a* being a cross-sectional side view and FIG. 1*b* being a bottom view of the iron, FIG. 2 is a diagrammatic cross-sectional side view of a second embodiment of an iron according to the invention, FIG. 3 is a diagrammatic bottom view of a third embodiment of an iron according to the invention, and FIGS. 4*a* and 4*b* are diagrammatic views of a fourth and a fifth embodiment of an iron according to the invention, FIG. 4*a* being a cross-sectional side view and FIG. 4*b* being a bottom view of the iron.

FIGS. 1*a* and 1*b* show a first embodiment of an iron 1 according to the invention, comprising a housing 2, a soleplate 3 which is to be moved over a fabric 4 during operation, and heating means 5 for heating the soleplate 3. In this embodiment the iron comprises a control knob 25 for limiting the operating temperature of the heated part of soleplate 3 to a specific value dependent on the type of fabric to be ironed. Such control knobs are generally known and will not be further elucidated here.

The soleplate 3 comprises cooling means 6 for setting at least a part of the fabric during operation, which means are provided, seen in the displacement direction X, behind a part 31 of the soleplate which is heated by the heating means 5. As can be seen in FIG. 1*b*, the cooling means 6 in this embodiment comprise a plurality of air vents 16 which are provided in the soleplate 3 and are connected to a unit 26 for generating an air flow through the air vents during operation. It is to be understood that, although in this embodiment the air flow generating unit 26 is located within the iron 1, it may alternatively be located outside the iron while having a connection to the air vents 16. In this embodiment, the cooling means 6 are provided in a rear part 7 of the soleplate 3. During operation the iron 1 is moved over the fabric 4, and the weight and movement of the iron cause the fibers in the fabric to be under tensile and compression forces. First the heating means 5 heat the fibers in the fabric 4, which causes the fibers to stretch and become softer and movable. Then an air flow is generated by the unit 26 and applied to the fabric via the air vents 16 to cool down the fibers in the fabric at the end of one ironing stroke during operation. Since the cooling means 6 are integrated into the soleplate 3 and the soleplate 3 is still in contact with the fabric during cooling, the fibres are still under tensile and compression forces while they are being cooled down. In this manner an effective setting of the fibers is realized, which enhances the result of the ironing.

It is advantageous when the cooling rate of the cooling means 6 is controllable. The temperature at which the fibers of a fabric become soft and moveable differs among fabrics, and thus the cooling rate should also differ in dependence on the type of fabric ironed. For removing wrinkles from nylon, for example, heating of the fabric up to about 50° C. suffices. This results in a cooling rate which may be relatively low compared with the cooling rate needed for a comparatively fast cooling down of, for example, cotton, which is heated to about 150° C. during ironing.

FIG. 2 shows a further embodiment of an iron 1 according to the invention, in which the soleplate comprises at least a first zone 31 which is heated during operation by the heating means 5, and the cooling means 6 comprise at least a second zone 32 which is cooled during operation by a cooling device 36. The parts in FIG. 2 which correspond to the parts in FIGS. 1*a* and 1*b* have corresponding reference numbers.

In this embodiment, the cooling device 36 comprises a Peltier element. The Peltier element 36 is in thermal connection with the second zone 32 for cooling this second zone 32, and realizes a cooling down and setting of the fibers in the fabric which are present below the second zone 32 of the soleplate 3 during operation. Its size and cooling characteristics, render the Peltier element very suitable for use as a cooling device in an iron according to the invention. It furthermore provides a relatively easy control of the cooling rate, which is found to be advantageous as described above.

It is noted that a thermal insulation 50 is provided to thermally insulate the second zone 32 from the heated first zone 31 for a proper operation of the iron according to the invention. The first zone advantageously comprises a material with a high thermal conductivity for properly transferring the heat from the heating means to the fabric. The second zone, however, should be kept as cool as possible. This thermal insulation may be realized by the second zone comprising a material with a low thermal conductivity at least at its connection point with the first zone.

In this embodiment, the cooling rate of the Peltier element is controllable by means of a second control knob 35. With the first control knob 25, a user can preset an optimum heating temperature in dependence on a type of fabric which is to be ironed, as described above; and the user can preset a cooling rate which is an optimum for specific types of fabric with the second control knob in a similar manner. It is noted that the control of both the heating and the cooling may also be integrated into one control knob, which controls both the temperature of the heating element and the cooling rate of the cooling means in dependence on the selected type of fabric.

FIG. 3 shows a third embodiment of an iron 1 according to the invention, in which the soleplate 3 comprises a plurality of zones 31', 131 which are heated during operation, and a plurality of zones 32', 132 which are cooled during operation. In this manner the fabric is exposed to alternate heating and cooling actions during operation of the iron according to the invention. It has been found that this alternate heating and cooling during operation further enhances the setting and fixation of the fibers in the fabric, which benefits the final result of the ironing. The zones 31', 131, 32', 132 are arranged in a predetermined pattern. This pattern may be varied to suit the type of iron. In a steam iron, for example, the arrangement of the zones to be heated and the zones to be cooled down in the soleplate may be dependent on the preferred locations of steam outlets. An iron without a steam function may benefit from an arrangement of heated and cooled zones in a different pattern.

FIGS. 4*a* and 4*b* show a fourth and a fifth embodiment of an iron 1 according to the invention, in which the cooling means 6 comprise a water reservoir 8 and a thermal connection 46 between the water reservoir 8 and the soleplate 3. In this embodiment, a thermal insulation, which is not shown here in any further detail, is provided around the water reservoir to avoid heating up of the contents of the reservoir by heat being radiated from the heating means within the housing. In this embodiment the thermal connection 46 comprises an element 56 made of a material with a comparatively high thermal conductivity such as, for example copper, which element has one end 58 which is in thermal contact with the water reservoir 8 and another end 57 which is in thermal contact with the soleplate 3.

During operation, the water reservoir 8 is filled with water. A movement of the iron over the fabric 4, brings a portion of the fabric which has first been heated into contact with the part of the soleplate which is connected to the water reservoir via a thermal connection, in this embodiment the second zone 32". The heat in the fabric 4 is then at least partly transferred via the element 56 made of a material with a comparatively high thermal conductivity to the water reservoir 8. The water in the water reservoir 8 takes up at least a part of this heat, which causes the fabric to be cooled down to a lower temperature. In a further embodiment, the thermal connection 46 comprises a water column 66 present during operation in a channel 76 which has one end 68 which is in open communication with the water reservoir 8 and another end 67 which is in thermal contact with the soleplate 3. In this embodiment the water column 66 fulfills the function of a thermal connection 46 in a manner similar to the element 56. If the iron is a steam iron, the water in the water reservoir 8 may also serve for steaming.

It is noted that during operation the reservoir 8 may also be filled with a suitable chemical substance in a mixture with water which further enhances the absorption of heat coming from the fabric, or the reservoir may even contain only such a chemical substance, without any water, or a mixture of water with one or more other chemical substances. This may comprise, for example, a mixture of alcohol and water, or an aqueous salt solution as is used, for example, in a known cooling device for a depilation apparatus.

It is noted that the cooling means 6 in an iron according to the invention are not limited to the embodiments described above. The cooling means 6 may, for example, also comprise a freezer pack which after being frozen is inserted into a suitable space in the soleplate 3, or the second zone 32 being made of a material with a very low thermal conductivity which is thermally insulated from the first zone.

The cooling means for setting at least a portion of the fabric during operation improve the setting of the fibers in the fabric. When the iron is moved over the fabric, the weight and movement of the iron cause tensile and compression forces in the fibers. After the fibers in the fabric have been heated, the cooling means comprised in the soleplate subsequently cool down the fibers which are still under tensile and compression forces, because the soleplate is still in contact with the fabric. This causes the fibers to become set quickly and effectively, which improves the result of the ironing.

The invention claimed is:

1. An iron (1) comprising a housing (2), a soleplate (3) which is to be moved in a displacement direction over a fabric (4) during operation, and heating means (5) for heating the soleplate (3), characterized in that the soleplate (3) comprises cooling means (6) for setting at least a portion of the fabric during operation when a heated part of said soleplate is in contact with the fabric, which cooling means are provided, seen in the displacement direction, behind a part (31) of the soleplate which is heated by the heating means (5).

2. An iron as claimed in claim 1, characterized in that the cooling means (6) are provided in at least a rear part (7) of the soleplate (3), seen in the displacement direction.

3. An iron comprising a housing, a soleplate which is to be moved in a displacement direction over a fabric during operation, and heating means for heating the soleplate, wherein the soleplate comprises cooling means for setting at least a portion of the fabric during operation, which cooling means is provided, seen in the displacement direction, behind a part of the soleplate which is heated by the heating means, and wherein the cooling means comprise a plurality of air vents which are provided in the soleplate and are connected to a unit for generating an air flow through the air vents during operation.

4. An iron as claimed in claim 1, characterized in that the soleplate (3) comprises at least a first zone (31) which is heated by the heating means (5) during operation, and the cooling means (6) comprise at least a second zone (32) which is cooled by a cooling device (36) during operation.

5. An iron as claimed in claim 4, characterized in that a thermal insulation (50) is provided between the first zone (31) and the second zone (32).

6. An iron comprising a housing, a soleplate which is to be moved in a displacement direction over a fabric during operation, and heating means for heating the soleplate, wherein the soleplate comprises cooling means for setting at least a portion of the fabric during operation, which cooling means are provided, seen in the displacement direction, behind a part of the soleplate which is heated by the heating means, and wherein the cooling means have a controllable cooling rate.

7. An iron as claimed in claim 4, characterized in that the cooling device (36) comprises at least one Peltier element.

8. An iron as claimed in claim 4, characterized in that the soleplate (3) comprises a plurality of zones (31', 131) which are heated during operation and a plurality of zones (32', 132) which are cooled during operation.

9. An iron comprising a housing, a soleplate which is to be moved in a displacement direction over a fabric during operation, and heating means for heating the soleplate, wherein the soleplate comprises cooling means for setting at least a portion of the fabric during operation, which cooling means are provided, seen in the displacement direction, behind a part of the soleplate which is heated by the heating means, and wherein the cooling means comprise a water reservoir and a thermal connection between the water reservoir and the soleplate.

10. An iron as claimed in claim 9, wherein the thermal connection comprises an element made of a material with a comparatively high thermal conductivity, which element has one end which is in thermal contact with the water reservoir and another end which is in thermal contact with the soleplate.

11. An iron as claimed in claim 9, wherein the thermal connection comprises a water column which is present during operation in a channel, which channel has one end which is in open communication with the water reservoir and another end which is in thermal contact with the soleplate.

12. An iron comprising a housing, a soleplate which is to be moved in a displacement direction over a fabric during operation, and a heating element for heating the soleplate, wherein the soleplate comprises a cooling element for setting at least a portion of the fabric during operation when a heated part of said soleplate is in contact with the fabric, which cooling element is provided, seen in the displacement direction, behind a part of the soleplate which is heated by the heating element.

* * * * *